US005132592A

United States Patent [19]

Nugues et al.

[11] Patent Number: 5,132,592

[45] Date of Patent: Jul. 21, 1992

[54] CAPACATIVE LOADING COMPENSATING SUPPORTS FOR A HELIX DELAY LINE

[75] Inventors: Pierre Nugues, Auneau; Dominique Henry, Elancourt, both of France

[73] Assignee: Thomson Tubes Electroniques, Boulogne Billancourt, France

[21] Appl. No.: 528,052

[22] Filed: May 23, 1990

[30] Foreign Application Priority Data

May 30, 1989 [FR] France ..... 89 07081

[51] Int. Cl.[5] ..... H01J 23/30

[52] U.S. Cl. ..... 315/3.5; 315/39.3

[58] Field of Search ..... 315/3.5, 3.6, 39.3, 315/39 TW; 29/600, 601

[56] References Cited

U.S. PATENT DOCUMENTS

| | | | |
|---|---|---|---|
| 2,806,170 | 9/1957 | Bianculli | 315/3.5 |
| 2,889,487 | 6/1959 | Birdsall et al. | 315/3.6 |
| 3,209,198 | 9/1965 | Long et al. | 315/3.5 |
| 3,271,615 | 9/1966 | Washburn, Jr. | 315/3.5 |
| 3,397,339 | 8/1968 | Beaver et al. | 315/3.5 |
| 3,421,040 | 1/1969 | Winslow | 315/3.5 |
| 3,670,196 | 6/1972 | Smith | 315/3.5 |
| 3,691,630 | 9/1972 | Burgess et al. | 315/3.5 X |
| 3,972,005 | 7/1976 | Nevins, Jr. et al. | 315/3.5 X |
| 4,264,842 | 4/1981 | Galuppi | 315/3.5 |
| 4,278,914 | 7/1981 | Harper | 315/3.5 |
| 4,689,276 | 8/1987 | Jacquez | 428/594 |

FOREIGN PATENT DOCUMENTS

| | | | |
|---|---|---|---|
| 0004492 | 10/1979 | European Pat. Off. . | |
| 75738 | 5/1983 | Japan | 315/3.6 |

*Primary Examiner*—Eugene R. LaRoche
*Assistant Examiner*—Benny T. Lee
*Attorney, Agent, or Firm*—Roland Plottel

[57] ABSTRACT

Disclosed is a method for the construction of helix travelling wave tubes in which the helix is supported by insulating dielectric supports, wherein the dielectric supports, in turn, are supported by support-forming elements which project from the internal wall of the vacuum-tight casing surrounding the set, towards the helix, thus reducing the radial dimensions of the dielectric supports. In most of the embodiments, these novel support-forming elements are made of metallic material. The disclosed method greatly simplifies the construction of delay lines with low dispersion for travelling wave tubes with very great bandwidth while, at the same time, increasing the precision of assembly that can be obtained. An additional advantage of the reduction of the radial dimensions of the dielectric lies in an improvement of the possibilities of thermal conduction from the helix to the casing that surrounds the set. Another advantage of this reduction is the possibility of using costly dielectric materials such as diamond or boron nitride with face-centered cubic lattice structure.

10 Claims, 3 Drawing Sheets

"PRIOR ART"

"PRIOR ART"

"PRIOR ART"

CAPACATIVE LOADING COMPENSATING SUPPORTS FOR A HELIX DELAY LINE

BACKGROUND OF THE INVENTION

1. Field of the Invention

The present invention concerns a particular construction that enables the fabrication of travelling wave tubes with very great bandwidth and very little dispersion. This construction employs supporting the helix of the delay line of a travelling wave tube by means of insulating dielectric supports placed between the helix and vanes or other metal supports projecting towards the center from a metal casing that surrounds the helix.

The invention also concerns a travelling wave tube fabricated according to this construction method.

2. Description of the Prior Art

Travelling wave tubes (TWTs) are well known in the prior art and are preferred to other microwave tubes for applications that require a very wide intrinsic passband in amplification. The wide passband permitted by the helical construction of the delay line results from the low dispersion of the electromagnetic waves that are propagated along the delay line as a function of the frequency: in other words, the velocity v of the wave that is propagated along the helical line depends only very little on the frequency of the wave in a wide range of frequencies centered on the nominal frequency of operation of the travelling wave tube.

The coupling between the high frequency (HF) signal applied to the input of the tube and, from there, to the helix delay line, on the one hand, and the electron beam, on the other, depends on the synchronism of the propagation of both of them along the longitudinal direction of the travelling wave tubes. The velocity of the electron beam depends, in an initial rough calculation, on the acceleration voltages created inside the tube and then, in a more precise calculation, it is modified by the exchange of energy that is produced with the electromagnetic field. While, in the initial rough calculation, the velocity of the high-frequency wave that is propagated along the helix depends only on the geometry of the helix, further calculation shows it also depends slightly on the frequency, and this finally restricts the passband of the travelling wave tube.

For practical reasons, the use of the travelling wave tube in amplifier equipment does not provide for the setting of the operating voltages to modify the velocity of the electrons of the beam when the signal to be amplified varies, and it is consequently desirable to have as small a variation as possible in the velocity of the electromagnetic wave as a function of frequency. However in all the methods of practical construction of a delay line, the phase velocity of the the electromagnetic wave depends on the frequency, and this gives rise to a dispersion of $d=Vp/Vg$, where Vp is the phase velocity along the delay line at the working frequency and Vg is the group velocity.

FIG. 1 reproduces a typical curve representing the variation of the ratio c/v as a function of the wavelength, where c is the velocity of light. It is applicable both to the prior art and to the present invention. A value of d approximately equal to unity means that the phase speed along the delay line is practically constant when the frequency varies: this is the condition to be fulfilled for wideband operation, if possible throughout the operating bandwidth. A very high value of d corresponds either to an infinite value of Vp (wave guided at the cut-off frequency) or to a value of Vg close to zero. This means that the energy is not propagated along the delay line.

In practice, for any wave propagation circuit (in this case the delay line) having periodic electrical or geometric characteristics, the circuit stops transmitting energy in a given mode of propagation at the frequencies such that the half wavelength in this mode is equal to the period of the geometrical characteristics of the delay line. These frequencies are called "$\pi$ mode cut-off frequencies". There are also zero mode cut-off frequencies when the phase difference on a period of the slow wave structure is equal to zero or to a multiple of $2\pi$.

At these frequencies, the dispersion as defined above tends towards infinity. These cut-off frequencies cannot be avoided in a real physical circuit because Vg cannot grow indefinitely as and when Vp grows indefinitely, any more than $V_g$ can be prevented from becoming infinitesimally small for a finite value of Vp.

In the prior art, it is known that these cut-off frequencies can be shifted, but at the cost of a decrease in the efficiency of the travelling wave tube in operation: the intensity of the electrical field is reduced for a given level of the power being propagated in the delay line at a given phase velocity. This reduces the interaction with the electron beam in the tube. Should the cut-off frequencies be not shifted by any means, the experimentally observed cut-off frequencies may be called "natural cut-off frequencies".

According to one known prior art method for mitigating this drawback, an anisotropic load is added to the basic helix delay line. This gives a very low dispersion which may even become zero or negative.

The best known variant of this method for applying a load shown in FIG. 3, is the arrangement of U-shaped metal vanes with capacitive effect between the dielectric bars supporting the helix, the ends of which are positioned very near the helix (some tenths of a millimeter from it). It is difficult to obtain repeatable results economically in an industrial-scale fabrication process when this method is used. This method generally calls for resorting to a difficult brazing technique.

According to another known method in the prior art, capacitive loads are placed between the dielectric bars supporting the helix, as shown in FIG. 2, but this approach reduces the coupling impedance of the circuit and the efficiency of the tube.

In yet another known method, the above-mentioned U-shaped vanes, shown in FIG. 3, are replaced by localized metallizations of the dielectric bars supporting the helix, as shown in FIG. 4. This method is also difficult to implement on an industrial scale if repeatable results are to be obtained economically.

The invention is therefore aimed at obtaining a higher cut-off frequency without the drawbacks of prior art methods. The fundamental principles of physics used in the prior art can be brought out in a novel construction according to the invention. This gives a very low dispersion and, consequently, a widened useful passband while, at the same time, reducing the cost price of industrial-scale fabrication and the complexity of the helix assembly, and improving the repeatability of the characteristics of the tube.

SUMMARY OF THE INVENTION

A first object of the invention, therefore, is a method of construction of helix travelling wave tubes, wherein the helix is supported by dielectric supports, these dielectric supports being, in turn, supported by support-forming elements that project from the internal surface of the vacuum-tight casing surrounding the helix towards the helix positioned at the center of this casing, said support-forming elements having a finite electrical path length in the immediate vicinity of said dielectric supports such that the capacitive load of these dielectric supports is partially compensated for by the presence of said support-forming elements at the frequencies close to the natural cut-off frequency as it has been defined above.

Another object of the invention is a helix travelling wave tube incorporating this construction.

According to a preferred embodiment of the invention, said support-forming elements are made of metallic material.

According to one embodiment of the invention, the dielectric supports take the form of continuous bars which, in turn, are supported by metal supports. The dimensions of the dielectric supports are thus smaller than in the previous embodiment. This leads to an improvement in the thermal conductivity from the helix to the casing that surrounds the helix.

According to another embodiment of the invention, the dielectric supports take the form of discontinuous pads positioned between each turn of the helix and a continuous metal support. These pads may be positioned on the metal support before this sub-assembly is introduced into the casing surrounding the helix. This improves assembling precision and facilitates the fabrication of the tube. Furthermore, the small dimensions of the pads have the advantage of enabling the use of costly materials such as diamond and boron nitride with face-centered cubic lattice structure for example.

According to another embodiment of the invention, the continuous metal support takes the form of a vacuum-tight enveloping structure which, when placed within the jacket surrounding the helix, leaves a space between this external jacket and said support-forming structure, namely a space wherein a liquid or a cooling gas can be made to circulate.

BRIEF DESCRIPTION OF THE DRAWINGS

Other characteristics and advantages of the invention will appear from the following detailed description of non-restrictive exemplary embodiments, given in relation with the appended drawings, wherein.

Figure 1:
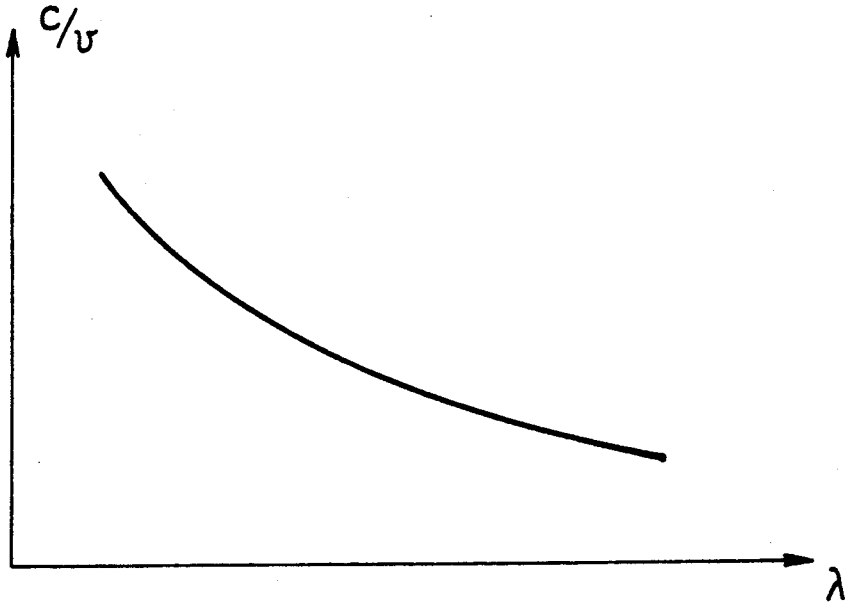
FIG. 1, already described further above, shows a typical curve illustrative of the technology and to both the prior art and the present invention representing the variation of the ratio between the velocity of light c and the velocity v of propagation of energy along the length of the helical slow wave structure as a function of the wavelength lambda, in arbitrary units.
Figure 2:
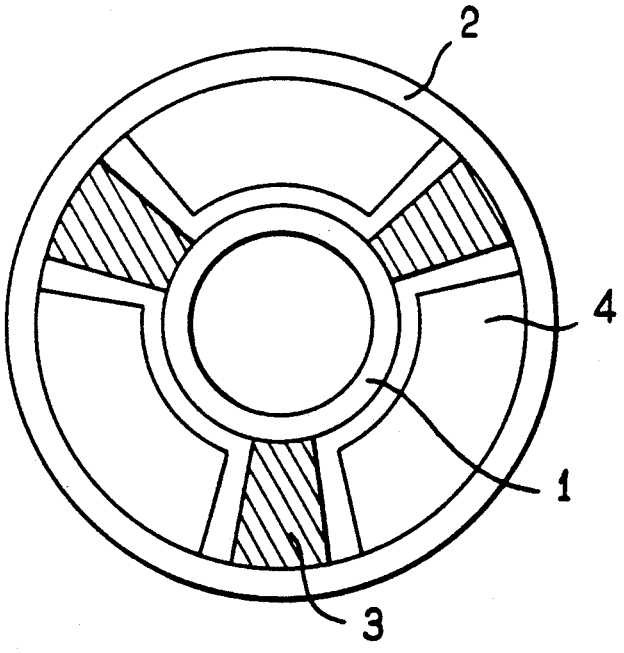
FIG. 2, already described further above, shows a cross-section view of a construction of a prior art helix delay line wherein the helix is supported by dielectric bars forming supports within a vacuum-tight cylindrical casing surrounding the helix, and wherein the support-forming dielectric bars are in contact with both the helix and the casing, and these solid metal "vanes" with capacitive load are positioned between the support-forming dielectric bars in the space between the casing and the helix.
Figure 3:
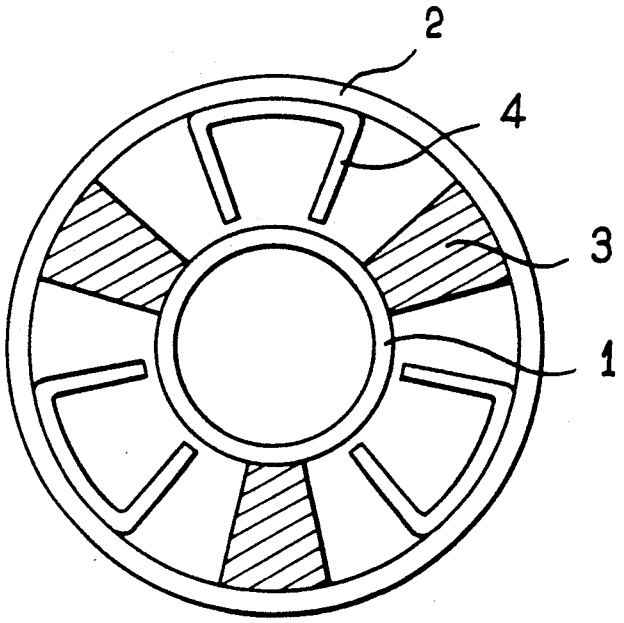
FIG. 3, already described further above, shows a cross-section view of a another construction of a prior art helix delay line, wherein the helix is supported by support-forming dielectric bars in contact with the helix and with a vacuum-tight cylindrical casing surrounding the helix as in FIG. 2, with U-shaped vanes positioned between the support-forming dielectric bars fixed to the internal wall of the vacuum-tight casing and projecting towards the helix up to a small distance from the helix.
Figure 4:
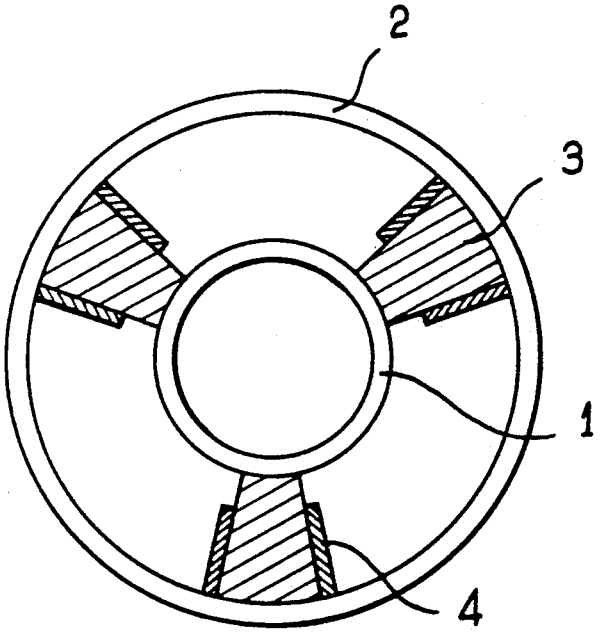
FIG. 4, already described further above, shows a cross-section view of another construction of a prior art helix delay line, wherein the helix is supported by support-forming dielectric bars in contact with the helix and with a vacuum-tight cylindrical casing surrounding the helix as in FIG. 2, with localized metallizations deposited on the faces of the dielectric bars facing the space located between the helix and the casing.

With regard to the drawings, wherein the same reference numbers are repeated for the same elements in the different embodiments, FIGS. 2, 3 and 4, which are included by way of explanation, represent known prior art structures wherein the helix 1 is supported in its vacuum-tight casing 2 surrounding the helix by means of dielectric bars 3, and metal elements 4 are positioned symmetrically in the space located between the helix and the casing and between the dielectric supports.

DESCRIPTION OF PREFERRED EMBODIMENTS

Figure 5:
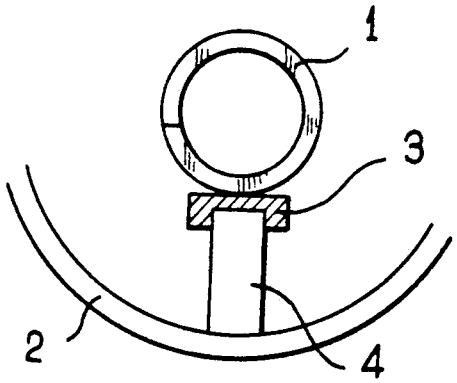
FIG. 5 shows a cross-section view of one embodiment of a helix delay line according to the invention, wherein support-forming U-shaped dielectric bars are positioned between the helix and the metal supports that project from the internal wall of the vacuum-tight cylindrical casing surrounding the helix, towards the helix.

FIG. 5 shows an example of a construction of a helix travelling wave tube according to the invention, wherein the helix 1 is supported in its vacuum-tight casing 2 surrounding the helix by insulating dielectric supports 3 which, in turn, are supported by metal elements 4 that project from the internal wall of the vacuum-tight casing 2 surrounding the helix, towards the helix, the dielectric supports 3 being positioned on these metal elements 4. In the exemplary embodiment of the invention shown in FIG. 5, a groove is formed along the length of the dielectric support 3 so that it can receive the edge of the metal element 4. This ensures precision of assembly and greatly simplifies the fabrication process as compared with the prior art.

Figure 6:
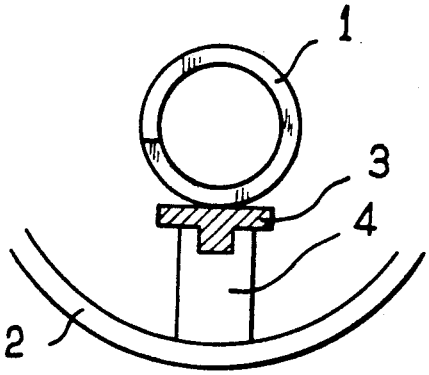
FIG. 6 shows a cross-section view of another embodiment of a helix delay line according to the invention, wherein support-forming T-shaped dielectric bars are positioned between the helix and grooved metal supports that project from the internal wall of the vacuum-tight cylindrical casing surrounding the helix, towards the helix.

FIG. 6 shows another exemplary construction of a helix travelling wave tube according to the invention, in which the helix 1 is supported in its vacuum-tight casing 2, surrounding the helix, by insulating dielectric supports 3, wherein the dielectric supports 3 are, in turn, supported by metal elements 4 that project from internal wall of the vacuum-tight casing 2 surrounding the helix, towards the helix, the dielectric supports 3 being positioned on these metal elements 4. In this exemplary embodiment of the invention shown in FIG. 6, a groove is made along the length of the metal element 4 so that it can receive the edge of the support-forming T-shaped dielectric bar 3. This ensures precision of assembly and greatly simplifies the fabrication process as compared with the prior art.

The metal elements of FIGS. 5 and 6 may advantageously have the shape of a wedge, the thick end of which lies on the internal face of the vacuum-tight casing 2 surrounding the helix.

Figure 7:
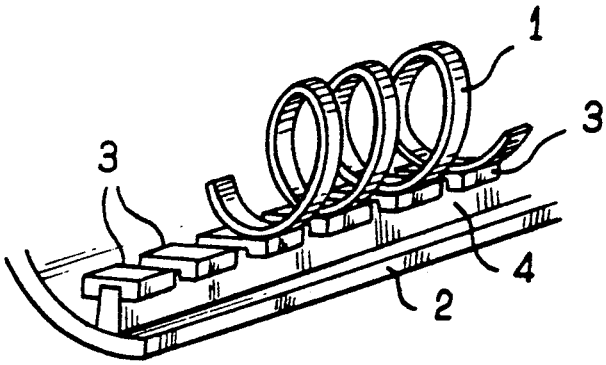
FIG. 7 shows a view in perspective of a detail of another embodiment of a helix delay line according to the invention, wherein the helix is supported by dielectric pads positioned between the helix and metal supports that project from the internal wall of the vacuum-tight cylindrical casing surrounding the helix, towards the helix.

FIG. 7 shows another exemplary construction of a helix travelling wave tube according to the invention, in which the helix 1 is supported in its vacuum-tight casing 2, surrounding the helix, by insulating dielectric supports 3, wherein the dielectric supports 3 are, in turn, supported by metal elements 4 that project from the internal wall of the vacuum-tight casing 2 surrounding the set, towards the helix, the metal elements 4 being positioned on these dielectric supports 3. In the exemplary embodiment of the invention shown in FIG. 7, the dielectric supports 3 are no longer continuous bars as in the two previous exemplary embodiments of the the invention shown in FIGS. 5 and 6. On the contrary, these dielectric supports 3 are discontinuous and formed by insulating dielectric pads positioned along the length of the continuous metal element 4 in such a way that they support each turn of the individual helix. As in the exemplary embodiment of the invention shown in FIG. 5 and described above, a groove is formed in the dielectric material to receive the edge of the metal element 4. This provides for precision of assembly. It is easily possible to conceive of other embodiments with the use of dielectric pads. For example, a groove may be formed along the length of the metal element as in FIG. 6, or local holes may be distributed along the length of the metal element to receive dielectric pads having a protruding part suitable for positioning or holding the pads in the groove or in the holes.

Figure 8:
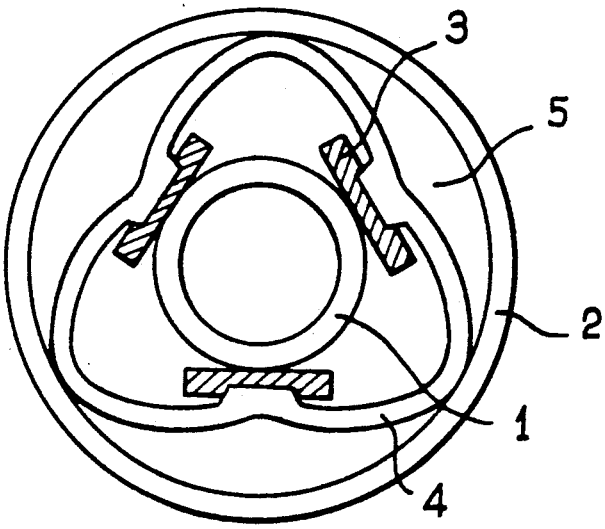
FIG. 8 shows a cross-section view of another embodiment of a helix delay line according to the invention, wherein support-forming dielectric bars or pads are positioned between the helix and a vacuum-tight metal structure surrounding the helix which, in turn, is positioned inside a cylindrical casing that surrounds the helix and creates spaces between itself and the support-forming structure, wherein a liquid or a cooling gas maybe put into circulation.

FIG. 8 shows another exemplary construction of a helix travelling wave tube according to the invention in which the helix 1 is supported in its vacuum-tight casing 2 surrounding the helix by insulating dielectric supports 3, wherein the dielectric supports 3 are, in turn, supported by a metal element 4, parts of which project from the internal wall of the vacuum-tight casing 2 surrounding the helix, towards the helix, the dielectric supports 3 being positioned on these parts. In this exemplary embodiment of the invention, shown in FIG. 8, a groove is formed along the length of the dielectric supports 3 so as to receive the support-forming ribs of the metal element 4. This provides for precision of assembly and greatly simplifies the fabrication process as compared with the prior art. A further characteristic of the exemplary embodiment according to the invention shown in FIG. 8 is that the metal elements 4 form a vacuum-tight casing that surrounds the helix 1 and is positioned inside the external cylindrical casing 2, defining and demarcating spaces 5 formed between the two casings, in which a a gas or a liquid may be put into circulation to cool the delay line.

In several preferred embodiments of the invention, as shown by the above-described non-restrictive examples and the corresponding FIGS. 5, 6, 7 and 8, metal elements 4 are used to support the dielectric elements 4 forming supports of the helix and providing for insulation, but the invention also concerns a construction that can be applied to the fabrication of helix delay lines wherein the metal elements 4 are replaced by any other material having a finite electrical length, positioned in the immediate vicinity of the dielectric supports 3 so as to partially compensate for the capacitive load effect of the dielectric at the frequencies close to the natural cut-off frequency. In the same way, the invention further concerns embodiments in which additional metal elements may be positioned between the elements 4 that support the dielectric supports 3 of the helix 1.

In any case, it is clear that the above-described assemblies illustrate only a small number of the numerous possible examples of application of the principles of the invention. Those skilled in the art will easily be able to conceive of a large number and a large variety of other assemblies in accordance with these principles, without going beyond the scope of the invention.

What is claimed is:

1. A delay line for helix traveling wave tubes, comprising a metallic helix for propagating an electromagnetic wave of a frequency within a predetermined frequency range having upper and lower limits, a first set of dielectric support elements in contact with said helix, a vacuum-tight external casing, and a second set of support elements, separate and distinct from said casing, in contact with said casing, said casing having an axis and radius perpendicular to said casing axis, said helix configured about a helix axis and defining a length aligned parallel to said helix axis and a helix radius perpendicular to said helix axis, said helix axis being coaxial with the axis of said casing, said helix being supported by said first set of dielectric support elements, said first set of dielectric support elements creating a capacitive loading of the electromagnetic wave propagating along said helix, said first set of dielectric support elements being supported by said second set of support elements, said external casing having an internal surface, said second set of support elements protruding radially inward from said internal surface of said external casing towards said helix, said second set of support elements further have a finite electrical path length in the radial direction with a radially innermost end portion of said second set of support elements being in mechanical contact with and supporting said first set of support elements, such that said capacitive loading of said first set of dielectric supports is partially compensated by the presence of said second set of support elements for said electromagnetic wave having frequencies near the upper limit of said predetermined frequency range whereby a natural cutoff frequency of the helix is partially compensated for.

2. A delay line for helix traveling wave tubes according to claim 1, wherein said support elements of finite electrical path length are of the form of metallic rods oriented parallel to said axis of said helix.

3. A delay line for helix traveling wave tubes according to claim 1, further comprising a recess in said second set of support elements having said finite electrical path length, and a protruding part in said first set of dielectric support elements, said protruding part mechanically interlocking in said recess, whereby facilitating precision assembly.

4. A delay line for helix traveling wave tubes according to claim 1, further comprising additional metallic elements located between said support elements having finite electrical path length, as to increase said partial compensation of said capacitive loading.

5. A delay line for helix traveling wave tubes according to claim 1, wherein said first set of dielectric supports are of the form of dielectric rods oriented parallel to said axis of said helix.

6. A delay line for helix traveling wave tubes according to claim 1, wherein said dielectric supports are comprised of a plurality of dielectric pads, each pad being, separated from one another in a direction parallel to said axis of said helix.

7. A delay line for helix traveling wave tubes according to claim 1, wherein said support elements of finite electrical path length are comprised of a metallic material.

8. A delay line for helix traveling wave tubes according to claim 4, wherein said metallic support elements are of the form of a vacuum tight sleeve oriented parallel to said axis of said helix.

9. A delay line for helix traveling wave tubes according to claim 8, wherein said vacuum tight metallic sleeve is located inside said external casing, and defining spaces in between said external casing and said vacuum tight metallic sleeve, whereby within said spaces a fluid flows for cooling purposes.

10. A delay line for helix travelling wave tubes according to claim 1, further comprising a recess in said first set of dielectric support elements, and a protruding part in said second set o support elements, said protruding part mechanically interlocking in said recess, whereby facilitating precision assembly.

* * * * *